United States Patent [19]

Brighoff

[11] 4,440,460

[45] Apr. 3, 1984

[54] FURNITURE AND DRAWER THEREFOR

[76] Inventor: John C. Brighoff, 2712 Sams Creek Rd., New Windsor, Md. 21776

[21] Appl. No.: 290,721

[22] Filed: Aug. 6, 1981

[51] Int. Cl.[3] ..... A47B 95/02

[52] U.S. Cl. ..... 312/320; 312/244; 220/94 R; 217/125; 16/111 R

[58] Field of Search ..... 312/320, 244, DIG. 33, 312/321; 217/125; 220/94 R; 16/110 R, 111 R, 114 B

[56] References Cited

U.S. PATENT DOCUMENTS

| | | | |
|---|---|---|---|
| 1,145,471 | 7/1915 | Dobrick | 16/111 R |
| 1,652,018 | 12/1927 | Kubelka | 16/111 R |
| 2,205,259 | 6/1940 | Harbison | 312/320 |
| 2,628,752 | 2/1953 | Corkish | 312/DIG. 33 |
| 2,677,852 | 5/1954 | Jain et al. | 16/111 R |
| 2,950,947 | 8/1960 | Ronzio | 312/320 |
| 3,189,938 | 6/1965 | Saunders | 312/320 |
| 3,251,638 | 5/1966 | Schwartz | 312/244 |
| 3,661,435 | 5/1972 | Miller | 312/321 |
| 4,003,611 | 1/1977 | Smith | 312/244 |
| 4,042,288 | 8/1977 | Litchfield | 312/320 |

FOREIGN PATENT DOCUMENTS

| | | | |
|---|---|---|---|
| 1352937 | 1/1964 | France | 16/111 R |
| 921395 | 3/1963 | United Kingdom | 312/320 |
| 1004300 | 9/1965 | United Kingdom | 16/111 R |

*Primary Examiner*—Victor N. Sakran

*Attorney, Agent, or Firm*—Edward D. C. Bartlett

[57] ABSTRACT

An article of furniture has one or more drawers in which the two side members are formed at their forward ends with reduced portions which form tenons that engage through and forwardly of vertically disposed mortise apertures adjacent each side edge of the front member. A rod is connected to and supported by the tenons at locations forwardly of the front member, the rod extending parallel to the front member in spaced relationship thereto. The rod forms a handle by which the drawer can be pulled open and pushed closed with the force necessary to open and close the drawer being transmitted directly through the rod to the side members. The rod also functions as a rail on which towels and similar articles can be hung.

15 Claims, 8 Drawing Figures

FURNITURE AND DRAWER THEREFOR

FIELD OF THE INVENTION

The present invention relates to furniture, particularly wooden bathroom, kitchen, and bedroom furniture, and drawers therefor.

BACKGROUND OF THE INVENTION

Good quality wooden drawers usually depend upon the front member for their strength, together with the two side members. The sides can be securely connected to the front by dovetailing. The drawers are pulled open and pushed closed either by directly gripping the front member, or by gripping one or two handles on the front member. Any force required to move the drawer is transmitted from the front member through the dovetail, or other, joints to the side members. This places substantial stress on these joints and can result in their weakening, becoming loose, and even breaking. Due to the cost of manufacturing, simpler, less expensive, techniques are often used to connect the sides to the front, but the resulting joints are prone to fail more readily.

SUMMARY OF THE INVENTION

It is an object of the present invention to mitigate failure of these joints.

It is a further object of this invention to enable a lighter weight front member to be employed if desired.

It is yet a further object of this invention to provide a drawer handle with greater utility.

According to the invention there is provided a wooden drawer for an article of furniture comprising a front member having two mortise apertures therethrough adjacent the side edges thereof. A pair of parallel side members each has a tenon at the forward end thereof engaged through and protruding forwardly beyond the corresponding mortise aperture, thereby forming a pair of mortise and tenon joints between the side members and the front member. A rod is connected to the portions of the tenons protruding forwardly beyond the front member, and extends parallel to the front member in spaced relationship therefrom. A back member is connected at its ends to the rear ends of the side members. A bottom of the drawer may be connected to the front, side, and back members.

The rod forms a handle by which the drawer can be pulled open with the force necessary to open the drawer being transmitted directly through the rod to the side members. Also, the rod forms a rail on which towels and similar articles can be hung.

Preferably, each of the tenons has a hole therethrough and the rod engages through these holes with the ends of the rod extending outside the tenons. The rod may be a press fit in the holes. The side members may additionally be rabbeted into the front member.

In a modification, particularly for a deep drawer, each side member comprises two coplanar parallel pieces each having a tenon at the forward end thereof, and the front member has two mortise apertures therethrough adjacent each side edge thereof; located in front of the front member and spaced therefrom are two parallel and vertically spaced apart rods with each rod being connected to a different pair of tenons.

According to the present invention there is also provided an article of furniture for use in a bedroom, bathroom or kitchen and having one or a plurality of drawers as described above.

DESCRIPTION OF PREFERRED EMBODIMENTS

Figure 1:
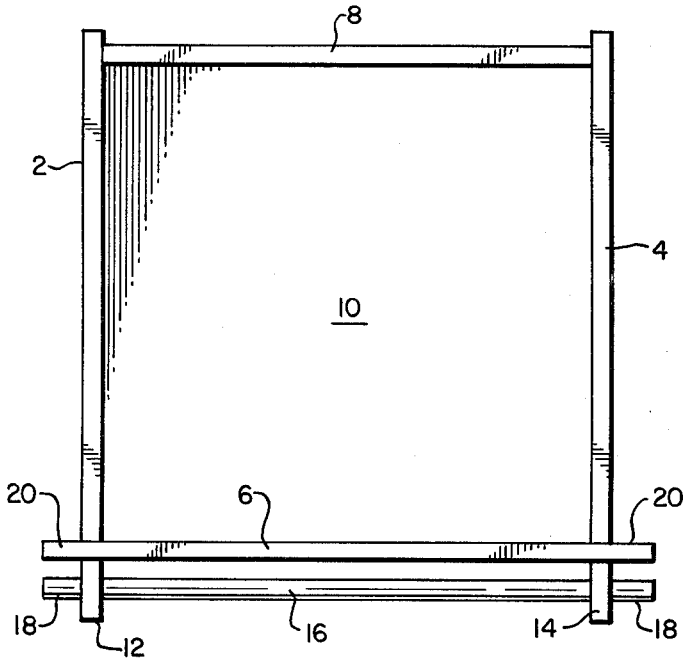
FIG. 1 is a plan view of a drawer according to the present invention.

FIG. 1 shows a top view of a drawer having side members 2,4, a front member 6, a back member 8, and a bottom 10. The forward ends of the sides 2,4 are formed as tenons 12,14 which extend through and forwardly of the front member 6. A wooden rod 16 of circular cross section extends through and is supported by the tenons 12,14. The rod 16 is parallel to and in spaced relationship in front of the front member 6. The rod 16 is the same length as the width of the front member 6 with the ends 18 of the rod 16 extending outwardly beyond the tenons 12,14. The ends 20 of the front member 6 also extend outwardly beyond the tenons 12,14.

Figure 2:
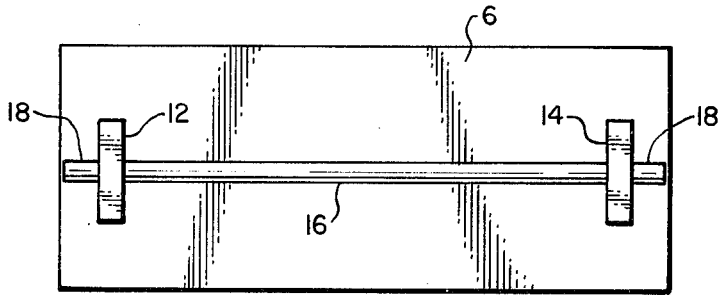
FIG. 2 is a front elevational view of the drawer of FIG. 1.

FIG. 2 is a front view of the drawer and shows the disposition of the tenons 12,14 and the rod 16 relative to the front member 6.

Figure 3:
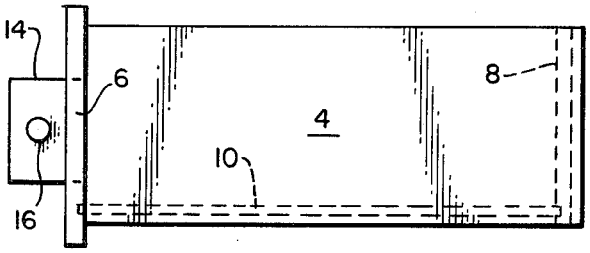
FIG. 3 is a side elevational view of the drawer of FIG. 1.

FIG. 3 is a view of the lefthand side of the drawer as shown in FIGS. 1 and 2, and shows how the tenon 14 is formed as a reduced forward portion of the side member 4. The position of the back member 8 and the bottom 10 are shown in broken lines. It should be noted that the front member 6 extends above and below the side member 4.

Figure 4:
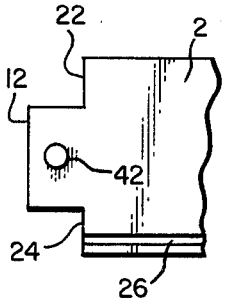
FIG. 4 is a fragmentary side elevational view of a side member of the drawer of FIG. 1.

FIG. 4 shows an inside side view of the front part of the side member 2. Shoulders 22,24 are formed above and below the tenon 12, and when the side member 2 is in place these shoulders 22,24 abut the front member 6. A rabbet groove 26 extends along the length of the side member 2 adjacent its lower edge for accommodating an edge of the bottom 10. The other side member 4 is similarly formed.

Figure 5:
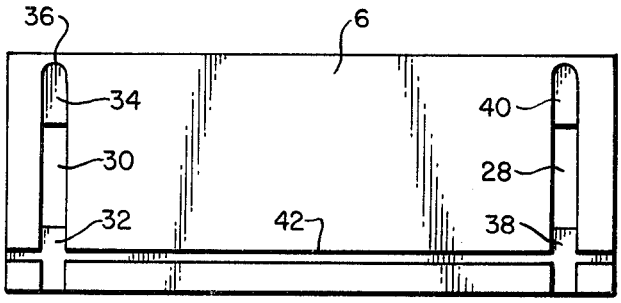
FIG. 5 is a rear elevational view of the front member of the drawer of FIG. 1.

FIG. 5 is a rear view of the front member 6 and shows vertically disposed mortise apertures 28,30 disposed adjacent the side edges of the front member 6. As clearly shown in FIG. 5, the two mortise apertures 28,30 are rectangular and parallel to each other. The mortise apertures 28,30 receive the tenons 12,14, respectively. A robbet groove is formed in line with the aperture 30 for receiving the front edge of the side member 4. The lower part 32 of this rabbet groove is open at each end, whereas the upper part 34 of this rabbet groove is closed at its upper end 36 to improve the appearance of the drawer, particularly when it is opened. A similar rabbet groove is formed in line with the mortise aperture 28 and has an open lower part 38 and a closed upper part 40. A rabbet groove 42 extends adjacent the bottom of the front member 6 for the full width thereof and is adapted to receive the front edge of the bottom 10.

Figure 6:
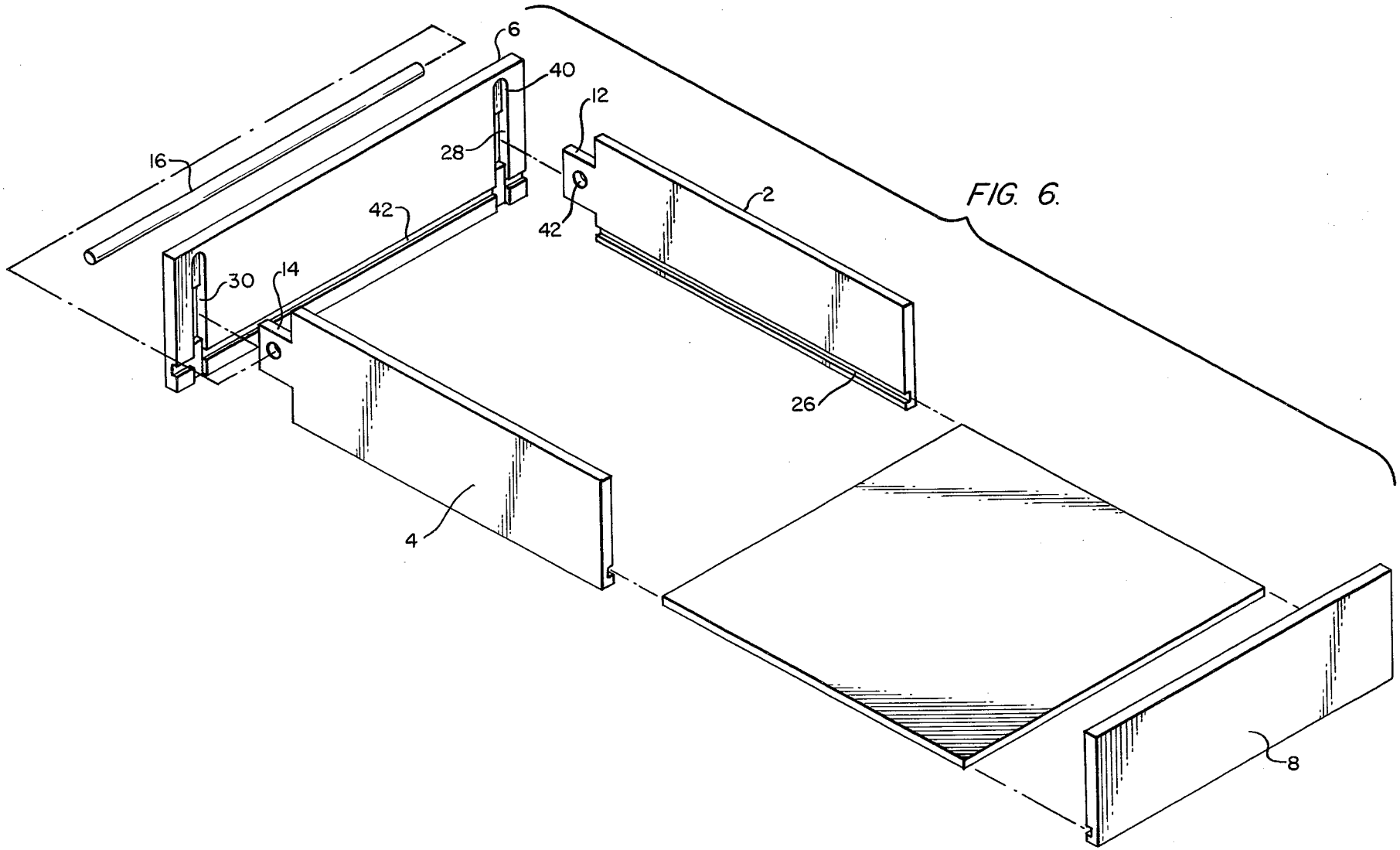
FIG. 6 illustrates an exploded perspective view of the drawer of FIGS. 1 to 5.

FIG. 6 shows an exploded view of the drawer of FIGS. 1 through 5.

To assemble the drawer the side members 2,4 are presented in turn to the rear of the front member 6 and the tenons 12,14 firmly inserted through the mortise apertures 28,30 with the shoulders 22,24 of the side members engaging fully in the rabbets 38,40 and 32,34, respectively. Preferably, these joints are glued. As will be appreciated with any mortise and tenon joint, the tenons 12, 14 are integral with the respective members 2, 4. The bottom 10 is then slid into position with its front edge engaging in the rabbet 42 of the front member 6, and its side edges engaging in the rabbets 26 in the side members. The back member 8 is then placed in position between the rear parts of the side members 2,4 with a rabbet groove, similar to the rabbet groove 26, engaging the rear edge of the bottom 10. The rear member 8 is then secured by panel pins to the side members 2,4 in known manner. Preferably, the four edges of the bottom 10 are glued in the rabbets they engage. Later, the rod 16 is inserted through holes 42 (see FIG. 4) in the tenons 12,14 until it is correctly positioned. The rod 16 is a press fit in the holes 42.

It will be appreciated that the rod 16 forms the handle of the drawer, and any force necessary to open or close the drawer that is applied to the handle 16 is transmitted through the tenons 12,14 directly to the side members 2,4. Thus, in effect, no strain is placed upon the joints between the side members 2,4 and the front member 6 when opening and closing the drawer. With this arrangement, the side members 2,4 are the main structural members of the drawer and not the front member 6. Consequently, the front member 6 can, if desired, be made of thinner wood, or of a less strong member, than is normally used for the front member of a drawer. If desired, the front member need be little more than a decorative member. It should also be noted that the rod 16, in addition to being the handle, functions as a rail upon which towels, articles of clothing, etc., can conveniently be hung.

Figure 7:
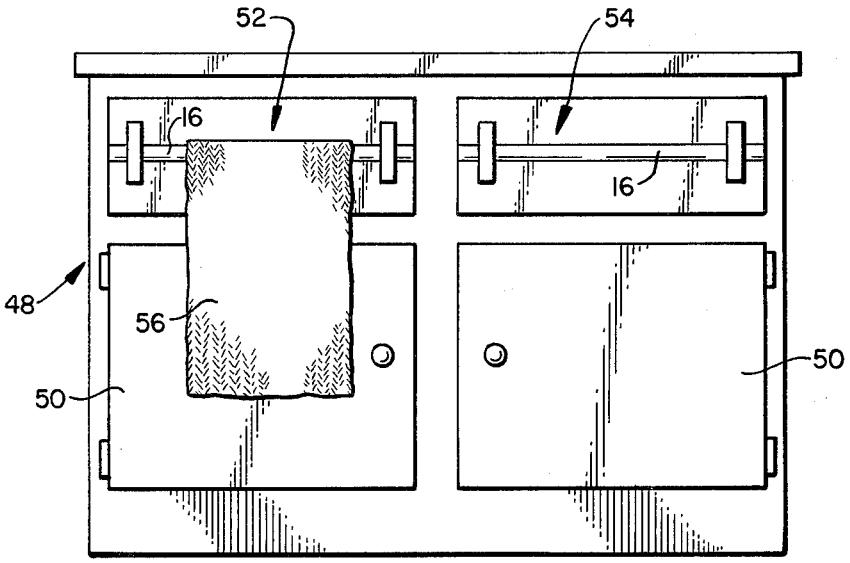
FIG. 7 is a front elevational view of an article of furniture according to the present invention containing two drawers as shown in FIGS. 1 through 6.

FIG. 7 shows a bathroom cabinet 48 having a pair of cabinet doors 50 and two drawers 52,54 each of which is the same as the drawer described above with reference to FIGS. 1 through 6. A towel 56 is shown conveniently hanging on the rod 16 of the drawer 52.

Figure 8:
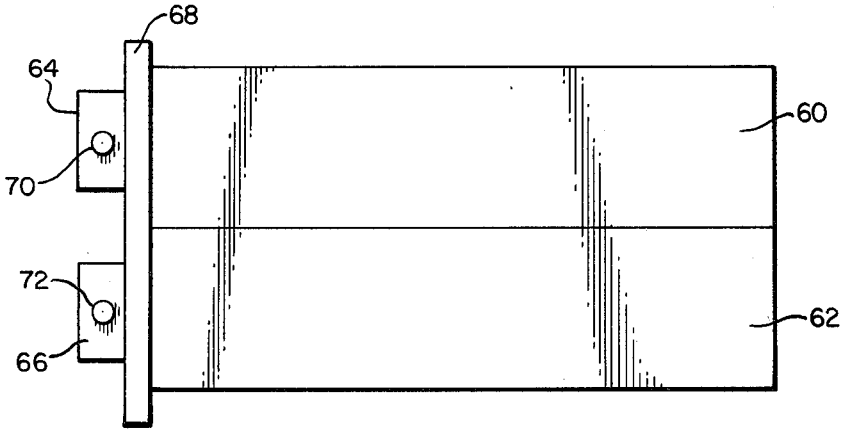
FIG. 8 is a side elevational view of another embodiment of a drawer according to the present invention.

FIG. 8 shows another embodiment of the invention particularly suited for very deep drawers. Each side member if formed by two coplanar parallel wooden pieces 60,62 each having a tenon 64,66, respectively, at the forward end. The front member 68 has a pair of vertically aligned mortise apertures adjacent each end and through which the tenons 64,66 extend. The tenons of the two top pieces 60 support a rod 70, and the tenon 66 of the bottom two pieces 62 support a second rod 72. In this way, a deep drawer can be made using similar dimensioned lumber for the side members as is used for a shallower normal depth drawer.

The above described embodiments, of course, are not to be construed as limiting the breadth of the present invention. Modifications, and other alternative constructions, will be apparent which are within the spirit and scope of the invention as claimed in the appended claims.

For example, the cross section of the rod 16 can be square, rectangular, oval, etc. Also, to make a cheaper drawer all the rabbeting can be omitted.

What is claimed is:

1. A drawer for an article of furniture comprising:

a wooden front member having two rectangular mortise apertures therethrough adjacent but spaced inwards of the side edges thereof, said mortise apertures being parallel to each other and being vertically disposed;

a pair of parallel wooden side members each having integral therewith a tenon extending forwardly at the forward end thereof, each said tenon being firmly inserted through and protruding forwardly beyond a respective one of said mortise apertures, said front member being secured to said pair of side members by the two mortise and tenon joints thereby made;

a rod connected to the portions of said tenons protruding forwardly beyond said front member, and extending parallel to said front member in spaced relationship therefrom;

a back member connected at its ends to the rear ends of said side members;

a bottom of the drawer connected to said front, side and back members; and said rod forming a handle by which the drawer can be pulled open with the force necessary to open the drawer being transmitted directly through said rod to said side members;

whereby said side members are the main structural members of the drawer, and in use failure of the joints between said wooden front member and said wooden side members is mitigated by said rod handle being connected to said tenons of said side members.

2. A drawer as recited in claim 1, wherein each of said tenons has a hole therethrough and said rod engages through said holes with the ends of said rod extending outside said tenons.

3. A drawer as recited in claim 2, wherein each of said front, side and rear members are rabbeted adjacent the lower edges thereof with the edges of said bottom being located in said rabbets.

4. A drawer as recited in claim 2, wherein said rod is a press fit in said holes.

5. A drawer as recited in claim 1, wherein each side member comprises two coplanar parallel pieces each having a tenon at the forward end thereof, and said front member has two mortise apertures therethrough adjacent each side edge thereof, and further comprising a second rod, the two rods being parallel and spaced vertically apart with each rod connected to a different pair of said tenons.

6. An article of furniture for use in a bedroom, bathroom or kitchen and having at least one drawer, said drawer comprising:

a wooden front member having two vertically extending mortise apertures therethrough adjacent but spaced inwards of the side edges thereof;

a pair of parallel wooden side members having integral therewith forwardly extending reduced portions at the forward ends thereof, said reduced portions being firmly inserted through and extending forwardly beyond said mortise apertures;

said front member being secured to said side members by two mortise and tenon joints made by said reduced portions being firmly inserted as tenons through said mortise apertures;

a rod connected to parts of said reduced portions extending forwardly beyond said mortise apertures, said rod being so connected at locations forwardly of said front member, and extending parallel to said front member in spaced relationship thereto; and said rod forming a handle by which the drawer can be pulled open and pushed closed with the force necessary to open and close the drawer being transmitted directly through said rod to said side members whereby in use failure of the joints between said front member and said side members is mitigated, and said rod further forming a rail on which towels and similar articles can be hung.

7. The article of furniture recited in claim 6, wherein said rod engages through holes in said reduced portions with the ends of said rod extending outwardly beyond said reduced portions.

8. The article of furniture recited in claim 7, wherein said front member extends outwardly beyond both of said side members.

9. The article of furniture recited in claim 8, wherein said side members are rabbeted into said front member.

10. The article of furniture recited in claim 9, wherein said rod is the same length as the width of said front member and extends parallel thereto for the full width thereof.

11. The article of furniture of claim 6, wherein:

a rabbet groove is formed in the inner face of said front member vertically in alignment with and communicating with each mortise aperture, each said rabbet groove extending above and below the respective mortise aperture;

shoulders are formed on each of said side members above and below the reduced portion thereof; and said shoulders of each side member engage fully in the rabbet groove communicating with the respective mortise aperture through which that side member is inserted.

12. The article of furniture of claim 11, wherein said mortise and tenon joints are glued.

13. The article of furniture of claim 11, wherein the upper end of each said rabbet groove above the respective mortise aperture is closed to improve the appearance of the drawer when opened.

14. The article of furniture of claim 13, wherein the lower end of each said rabbet groove below the respective mortise aperture is open.

15. The article of furniture of claim 11, wherein said rod is a press fit through holes in said reduced portions and extends for the full width of said front member.

* * * * *